US007205953B2

(12) United States Patent
Knadle, Jr. et al.

(10) Patent No.: US 7,205,953 B2
(45) Date of Patent: Apr. 17, 2007

(54) DIRECTIONAL ANTENNA ARRAY

(75) Inventors: Richard T. Knadle, Jr., Dix Hills, NY (US); Mark William Duron, East Patchogue, NY (US); Hal Charych, Poquott, NY (US); Henry Grossfeld, Great Neck, NY (US); Raj Bridgelall, Morgan Hill, CA (US)

(73) Assignee: Symbol Technologies, Inc., Holtsville, NY (US)

( * ) Notice: Subject to any disclaimer, the term of this patent is extended or adjusted under 35 U.S.C. 154(b) by 10 days.

(21) Appl. No.: 10/661,652

(22) Filed: Sep. 12, 2003

(65) Prior Publication Data

US 2005/0057418 A1 Mar. 17, 2005

(51) Int. Cl.
*H01Q 11/10* (2006.01)

(52) U.S. Cl. ..... 343/792.5; 343/815; 343/817; 343/818; 343/834

(58) Field of Classification Search ..... 343/792.5, 343/793, 815, 817–819, 833, 834
See application file for complete search history.

(56) References Cited

U.S. PATENT DOCUMENTS

| | | | | |
|---|---|---|---|---|
| 4,028,709 A | | 6/1977 | Berkowitz et al. | 343/819 |
| 4,218,686 A | | 8/1980 | Blonder | 343/819 |
| 4,336,543 A | | 6/1982 | Ganz et al. | 343/705 |
| 4,700,197 A | * | 10/1987 | Milne | 343/837 |
| 5,220,335 A | * | 6/1993 | Huang | 343/700 MS |
| 5,493,704 A | * | 2/1996 | Grangeat et al. | 455/575.5 |
| 5,612,706 A | | 3/1997 | Podell | 343/818 |
| D385,563 S | | 10/1997 | Podell | D14/230 |
| 5,712,643 A | | 1/1998 | Skladany | 343/700 MS |
| 5,748,156 A | * | 5/1998 | Weber | 343/762 |
| 5,898,410 A | | 4/1999 | DeMarre | 343/992.5 |
| 5,913,549 A | | 6/1999 | Skladany | 438/7 |
| 6,061,036 A | * | 5/2000 | MacDonald et al. | 343/873 |
| 6,069,564 A | | 5/2000 | Hatano et al. | 340/572.7 |

(Continued)

FOREIGN PATENT DOCUMENTS

EP 0598624 A 5/1994

(Continued)

OTHER PUBLICATIONS

Deal, William R. et al., A Now Quasi-Yagi Antenna For Planar Active Antenna Arrays, IEEE Transactions on Microwave Theory and Techniques, IEEE Inc., New York, US, vol. 48, No. 6, Jun. 2000 pp. 910-918.

*Primary Examiner*—Trinh Vo Dinh
(74) *Attorney, Agent, or Firm*—Ingrassia, Fisher & Lorenz, P.C.

(57) ABSTRACT

A directional antenna array is provided that includes a driven element and a first parasitic element separated from the driven element with the first parasitic element and/or the driven element having a width that is greater than about one-half a percent (0.5%) of an free-space wavelength of the directional antenna array. Alternatively or in conjunction, the directional antenna array includes a balun structure that is configured to couple the driven element to at least one of an electromagnetic energy source and an electromagnetic sink, and the balun structure includes a dipole structure, a first feed point extending from the dipole structure and a second feed point extending from the first parasitic element.

41 Claims, 8 Drawing Sheets

U.S. PATENT DOCUMENTS

| | | | | |
|---|---|---|---|---|
| 6,127,928 | A | 10/2000 | Issacman et al. | |
| 6,229,491 | B1 | 5/2001 | Bolden et al. | 343/708 |
| 6,307,524 | B1 * | 10/2001 | Britain | 343/795 |
| 6,326,922 | B1 | 12/2001 | Hegendoerfer | 343/700 MS |
| 6,353,406 | B1 * | 3/2002 | Lanzl et al. | 342/118 |
| 6,445,297 | B1 | 9/2002 | Nicholson | 340/572.7 |
| 6,483,476 | B2 | 11/2002 | Cox | 343/815 |
| 6,617,962 | B1 | 9/2003 | Horowitz et al. | |
| 6,809,699 | B2 * | 10/2004 | Chen et al. | 343/795 |
| 2002/0105473 | A1 * | 8/2002 | Cox | 343/818 |
| 2002/0139822 | A1 * | 10/2002 | Infanti | 224/197 |
| 2003/0125725 | A1 * | 7/2003 | Woodard et al. | 606/41 |
| 2003/0160730 | A1 * | 8/2003 | Alsliely | 343/818 |

FOREIGN PATENT DOCUMENTS

| | | | |
|---|---|---|---|
| EP | 0 718 912 | A1 | 6/1996 |
| EP | 1209615 | A | 5/2002 |
| GB | 2 393 076 | A | 3/2004 |
| JP | 10 032418 | A | 7/1996 |
| JP | 2000 322545 | A | 11/2000 |
| JP | 2001109853 | | 4/2001 |
| WO | WO/1998/37596 | A | 8/1998 |
| WO | WO/2004/015625 | A | 2/2004 |

* cited by examiner

DIRECTIONAL ANTENNA ARRAY

TECHNICAL FIELD

The present invention generally relates to an antenna, and more particularly relates to a directional antenna array.

BACKGROUND

Yagi-Uda antennas were originally described in the English language in an article written by H. Yagi (See H. Yagi, "Beam Transmission of the Ultra Short Waves," Proc. IRE. Vol. 16, pp. 715–741, June 1928). These directional dipole antennas, which are commonly referred to as Yagi antennas, have been used for many years and in many applications. For example, the Yagi antenna has been used for reception of television signals, point-to-point communications and other electronics applications.

The basic Yagi antenna typically includes a driven element, usually a half-wave dipole, which is driven from a source of electromagnetic energy or drives a sink of electromagnetic energy. The antenna also typically includes non-driven or parasitic elements that are arrayed with the driven element. These non-driven or parasitic elements generally comprise a reflector element on one side of the driven element and at least one director element on the other side of the driven element (i.e., the driven element is interposed between the reflector element and the director element). The driven element, reflector element and director element are usually positioned in a spaced relationship along an antenna axis with the director element or elements extending in a transmission or reception direction from the driven element. The length of the driven, reflector and director elements and the separations between these antenna elements specify the maximum Effective Isotropic Radiated Power (EIRP) of the antenna system (i.e., directive gain) in the antenna system's bore site direction.

Current trends in antenna designs reflect the desirability of low profile, directional antenna configurations that can conform to any number of shapes for a mobile or portable unit while providing highly directional antenna patterns, such as those achievable with the Yagi antenna. In addition, current trends in antenna designs reflect the desirability of the antenna to maintain structural shape and integrity after application of an external force, such as a surface impact. Such antenna designs are particularly desirable in portable or hand-held devices such as cellular telephones, satellite telephones and contactless interrogators of Automatic Identification (Auto ID) systems, such as Radio Frequency Identification (RFID) interrogators of RFID systems.

Accordingly, it is desirable to provide a low profile, directional antenna that can conform to any number of shapes while providing highly directional antenna patterns. In addition, it is desirable to provide an antenna that can maintain structural shape and integrity after application of an external force. Furthermore, it is desirable to provide such an antenna for portable or hand-held devices. Moreover, desirable features and characteristics of the present invention will become apparent from the subsequent detailed description and the appended claims, taken in conjunction with the accompanying drawings and the foregoing technical field and background.

BRIEF SUMMARY

A directional array antenna is provided in accordance with a first exemplary embodiment of the present invention. The directional array antenna comprises a driven element and a first parasitic element separated from the driven element. The first parasitic element and/or the driven element has a width that is preferably greater than about one-half a percent (0.5%) of an free-space wavelength of the directional antenna array.

Alternatively or in conjunction with the first exemplary embodiment, a directional array antenna is provided in accordance with a second exemplary embodiment. The directional antenna array includes a balun structure that is configured to couple the driven element to at least one of an electromagnetic energy source and an electromagnetic sink, and the balun structure includes a dipole structure, a first feed point extending from the dipole structure and a second feed point extending from the first parasitic element.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
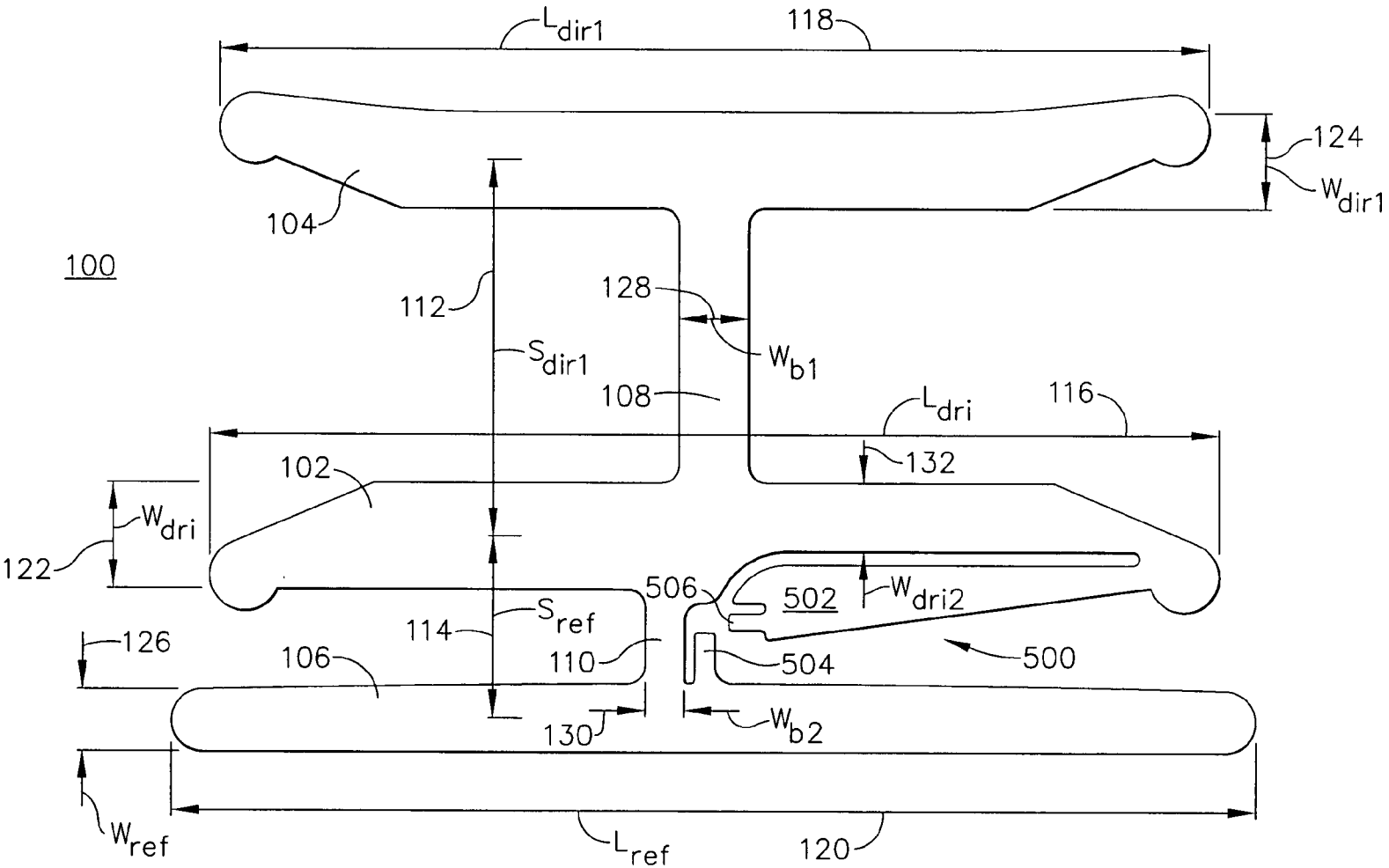
FIG. 1 a planar view of the directional array antenna in accordance with an exemplary embodiment of the present invention.
Figure 2:
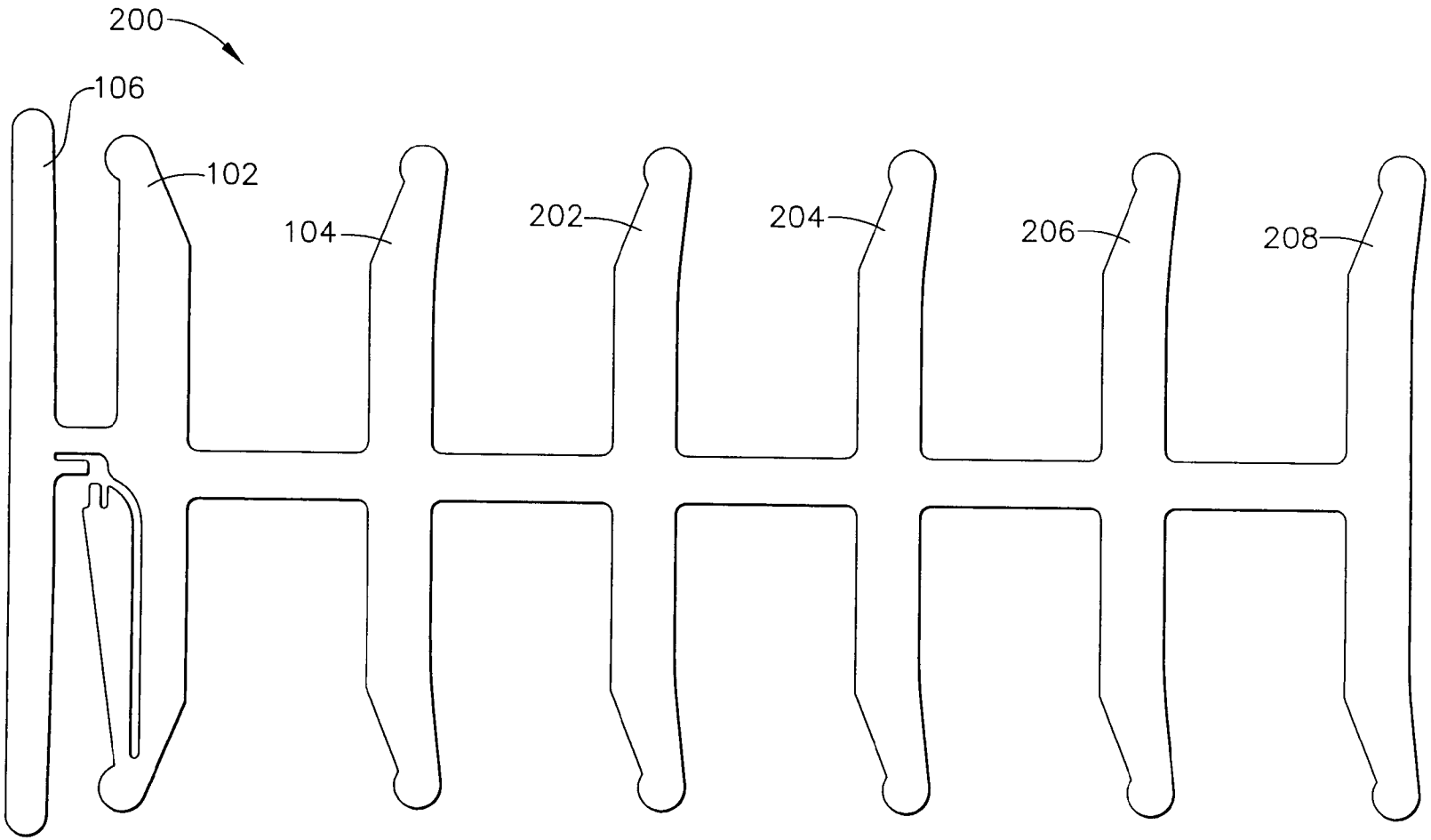
FIG. 2 is a planar view of the directional array antenna with parasitic elements in addition to the parasitic elements illustrated in FIG. 1.

Referring to FIG. 1, a planar view of a directional antenna array 100 is provided in accordance with an exemplary embodiment of the present invention. Generally, the directional antenna array 100 includes a driven element 102 and at least one (1) parasitic element or director element 104, and preferably a second parasitic element or reflector element 106 in addition to the director element 104. While only two parasitic elements (i.e., director element 104 and reflector element 106) are shown in FIG. 1 in addition to the driven element 102, any number of parasitic elements can be provided in accordance with an exemplary embodiment of the present invention. For example, a directional antenna array 200 is shown in FIG. 2 with four additional (4) parasitic elements (202, 204,206,208), which can be one or more additional director or reflector elements in addition to the director element 104 and reflector element 106 as shown in FIG. 1. Alternatively, the directional antenna array 100 can consist of (i.e., has no more or no less): a driven element and a reflector element; a driven element and a director element; a driven element and multiple reflectors, a driven element and multiple directors, or a driven element with a combination of one or more director elements and reflector elements. In addition, these one or more additional director or reflector elements can be in-plane elements or out-of-plane elements, such as a trigonal reflector system having a first reflector positioned above and a second reflector positioned below a third reflector.

With continuing reference to FIG. 1, the driven element 102 is preferably the equivalent of a center-fed, half-wave dipole antenna. The director element 104 is positioned on one side of the driven element 102 and connected with a boom 108 and the reflector element 106 is preferably positioned on the other side of the director element 102 and connected with another boom 110 such that the driven element 102 is interposed between the director element 104 and the reflector element 106. In addition, the director element 102 and the reflector element 106 are positioned in at least a substantially parallel relationship with respect to the driven element 102 and more preferably a parallel relationship with respect to the driven element 102.

In this exemplary embodiment, the directional antenna array 100 is a Yagi antenna. Accordingly, as known to those of ordinary skill in the art, the design of the directional antenna array 100 involves selection of parameters of the driven element 102, director element 104 and/or reflector element 106 and other parameters of additional parasitic elements of the directional antenna array 100 is such elements exist. For example, the design of the directional antenna array can include selection of spacing between the elements (e.g., spacing ($S_{dir1}$) 112 between the driven element 102 and the director element 104 and spacing ($S_{ref}$) 114 between the driven element 102 and the reflector element 106), element lengths (e.g., driven element length ($L_{dri}$) 116, director element length ($L_{dir1}$) 118 and reflector element length ($L_{ref}$) 120), element widths, which as used herein shall include element diameters (e.g., driven element width ($W_{dri}$) 122, director element width ($W_{dir1}$) 124 and reflector element width ($W_{ref}$) 126). However, other parameters and parameters of additional antenna structure(s) can be used in the design of the directional antenna array 100 in accordance with techniques known to those of ordinary skill in the art (e.g., boom widths ($W_{b1}$) 128, ($W_{b2}$) 130).

In accordance with an exemplary embodiment of the present invention, at least a portion of one of the driven element width ($W_{dri}$) 122, director element width ($W_{dir1}$) 124 and reflector element width ($W_{ref}$) 126 is greater than about one-half a percent (0.5%) of a free-space wavelength of an operating frequency of the directional antenna array 100, which shall be referred which shall be referred to herein as the free-space wavelength, and preferably the free-space wavelength of the center frequency of the directional antenna array 100. Preferably, at least a portion of one of the driven element width ($W_{dri}$) 122, director element width ($W_{dir1}$) 124 and reflector element width ($W_{ref}$) 126 is greater than about one percent (1%) of the free-space wavelength of the directional antenna array 100. More preferably, at least a portion of one of the driven element width ($W_{dri}$) 122, director element width ($W_{dir1}$) 124 and reflector element width ($W_{ref}$) 126 is greater than about two percent (2%), and most preferably greater than about four percent (4%). The driven element 102 is preferably the element with a portion having the width (i.e., $W_{dri}$ 122) that is greater than about one-half a percent (0.5%) of the free-space wavelength of the directional antenna array 100, preferably greater than about one percent (1%) of the free-space wavelength, more preferably greater than about two percent (2%) and most preferably greater than about four percent (4%).

In addition to at least a portion of one of the driven element 102, director element 104 and reflector element 106 having the width relationship to the free-space wavelength as previously described in this detailed description, the element shapes (i.e., round, square, triangular, pentagonal, hexagonal, etc.), the driven element length ($L_{dri}$) 116, the reflector element length ($L_{ref}$) 120, the director element length ($L_{dir}$) 118, the director element spacing ($S_{dir1}$) 112 and the reflector element spacing ($S_{ref}$) 114 are selected in accordance with the electrical resonant frequencies of the elements in accordance with techniques known to those of ordinary skill in the art. For example, the parameters of the directional antenna array 100 are selected such that the electrical frequency of resonance of the director element 104 is preferably greater than the free-space wavelength and the electrical frequency of resonance of the reflector element 106 is less than the free-space wavelength.

As known to those of ordinary skill in the art, any number of design variations exists for the directional antenna array (i.e., Yagi antenna) with the width relationship to the free-space wavelength in accordance with an exemplary embodiment of the present invention. For example, preferred boom width ($W_{b1}$) 128 and length and spacing of the driven element 102, director element 104 and reflector element 106 for a frequency range of approximately nine hundred and two megahertz (902 MHz) to about nine hundred and twenty-eight megahertz (928 MHz) is provided in Table 1.

TABLE 1

| | Driven | Director | Reflector |
|---|---|---|---|
| Width | 0.56 inches | 0.49 inches | 0.33 inches |
| % Width | 4.35% | 3.8% | 2.57% |
| Spacing | 0.89 inches | 2.75 inches | 0.89 inches |
| % Spacing | Not applicable | 14.4% | 6.9% |
| Length | 5.19 inches | 5.04 inches | 5.60 inches |
| % Length | 40.2% | 39% inches | 43.4% |

Where % Width, % Spacing and % Length are percentages of the free space wavelength and director spacing is the spacing ($S_{dir1}$) 112 between the driven element 102 and the director element 104 and the reflector spacing is the spacing ($S_{ref}$) 114 between the driven element 102 and the reflector element 106.

In accordance with an exemplary embodiment of the present invention, the illustrative example presented in Table 1, and other directional antenna arrays designed in accordance with the present invention, is preferably formed of a monolithic material having a thickness that is greater than about one skin depth at an operating frequency of the directional antenna array 100. The monolithic material can be any number of materials such as spring steel, beryllium copper, stainless steel or a combination thereof, and the monolithic material preferably can have a resistivity that is greater than about $0.1\times10^{-6}$ ohms-meter, preferably a resistivity that is greater than $0.2\times10^{-6}$ ohms-meter, more preferably greater than $0.4\times10^{-6}$ ohms-meter, even more preferably greater than $0.8\times10^{-6}$ ohms-meter, and most preferably greater than $1.0\times10^{-6}$ ohms-meter and $2.0\times10^{-6}$ ohms-meter. For example, the directional antenna array with the dimensions illustratively presented in Table 1 can be formed with a thickness of about one-sixteenth (1/16) inch FR-10 P.C. Board (PCB) and a two thousandths (0.002) inch copper tape formed on at least one side of the PCB.

Figure 3:
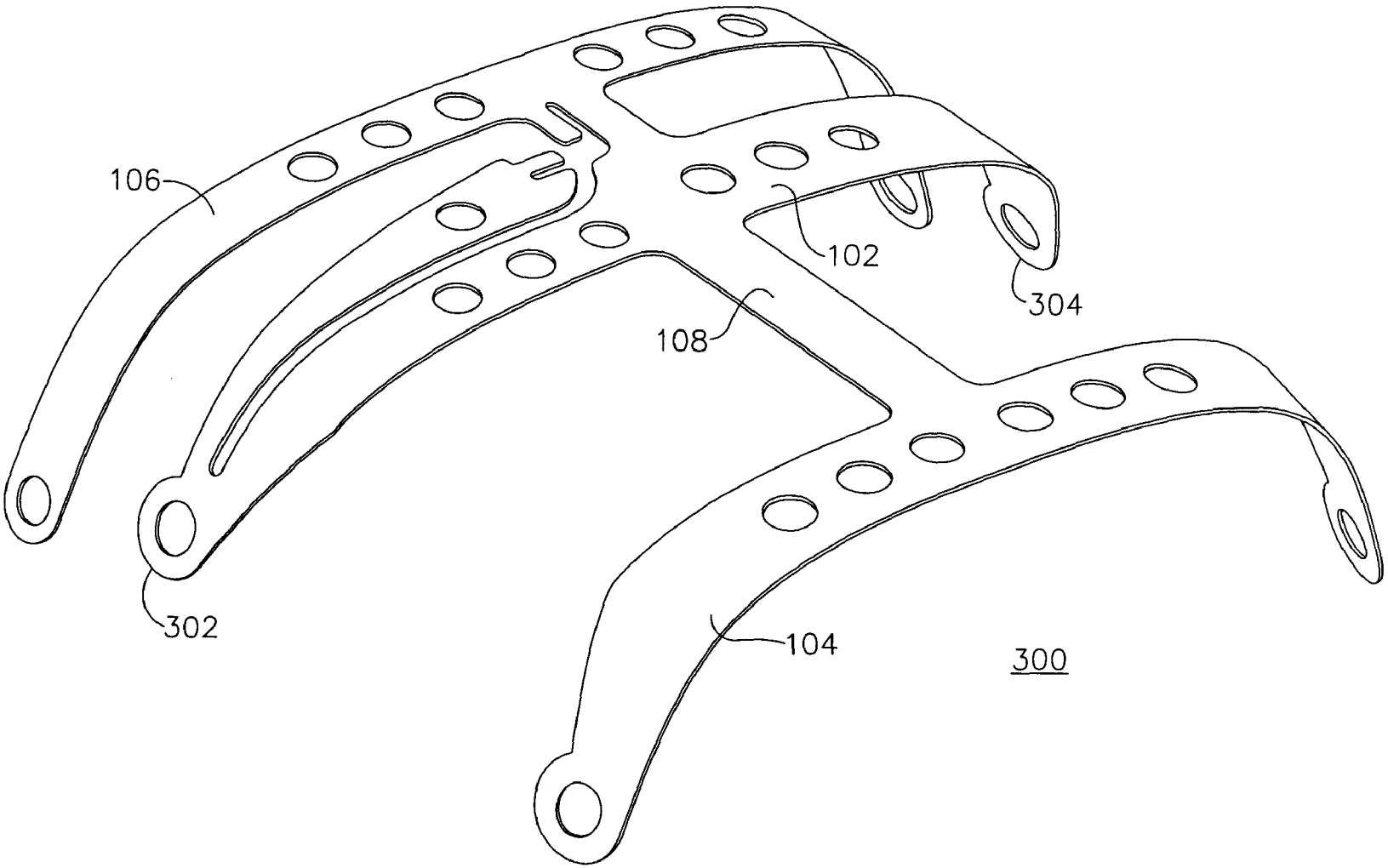
FIG. 3 is a first example of a non-planar folded configuration of the directional array antenna of FIG. 1 in accordance with an exemplary embodiment of the present invention.
Figure 4:
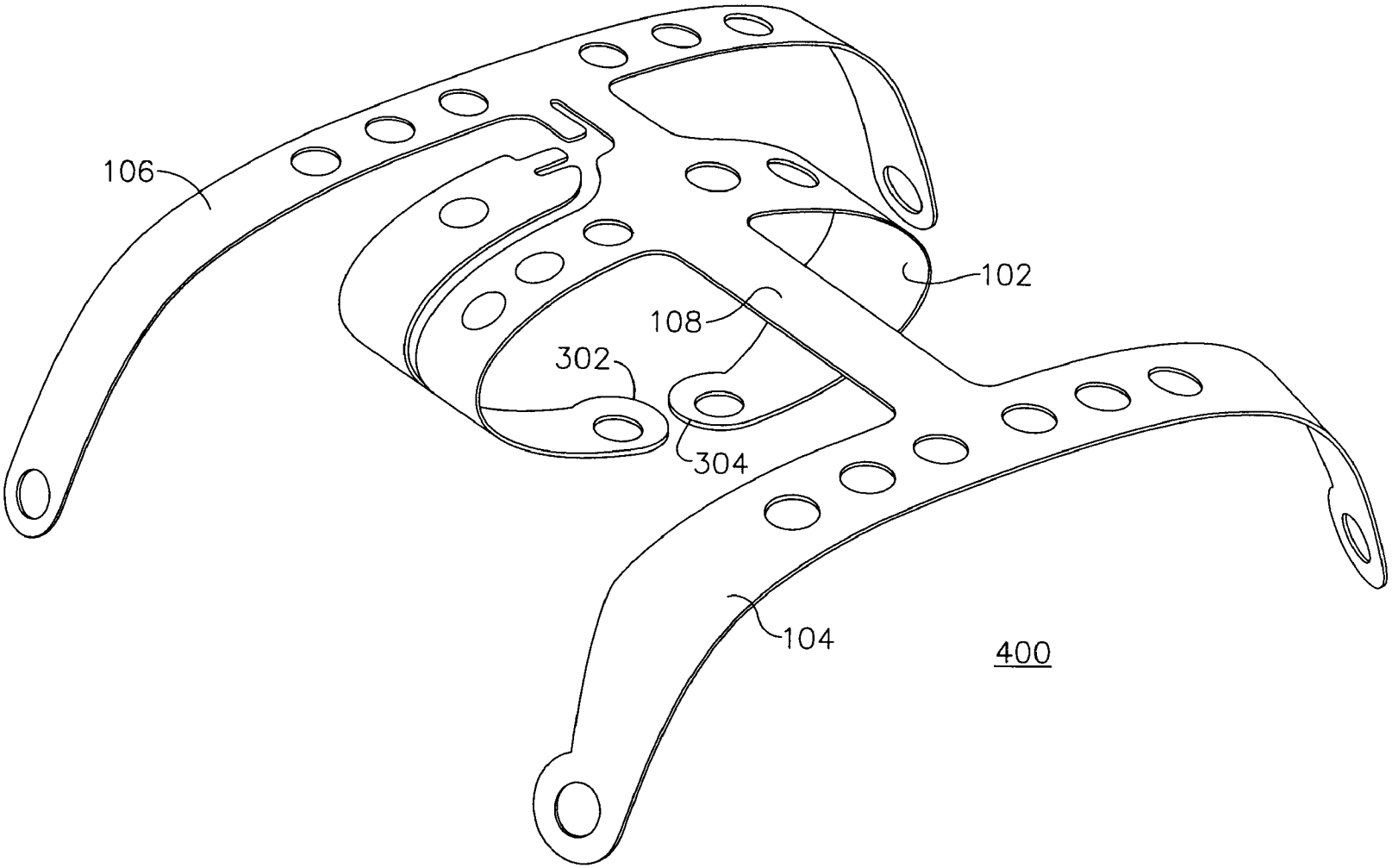
FIG. 4 is a second example of a non-planar folded configuration of the directional array antenna of FIG. 1 in accordance with an exemplary embodiment of the present invention.

With the directional antenna array 100 stamped, laser cut, water jet cut, or otherwise formed from the monolithic material, the driven element 102 is preferably formed into a non-planar folded configuration. For example, the distal ends (302,304) of the driven element 102 are folded to provide an angle of about ninety degrees (90°) with respect to the boom 108 to form the non-planar folded configuration 300 as shown in FIG. 3. Alternatively, and by way of example only, another non-planar configuration 400 can be formed by continuing to fold the distal ends (302,304) of the driven element 102 until such ends are substantially adjacent and preferably directly under the boom 108 as shown in FIG. 4 or folded into any number of other shapes other than the elliptical shape of FIG. 4 (circle, square, triangle, etc). Furthermore, the director element 102 and/or reflector element 104 can be folded in a manner that is similar or the same as the driven element as shown in FIG. 3, in a different manner that is not similar to the driven element as shown in FIG. 4, or in any other manner to provide specific antenna characteristics or antenna aesthetics.

Referring to FIG. 1, the driven element 102 is preferably coupled to a source of electromagnetic energy (not shown) and/or coupled to a sink of electromagnetic energy (not shown). The directional antenna array 100 of the present invention is inherently a balanced antenna, and the directional antenna array 100 is preferably coupled to the source and/or sink of electromagnetic energy to an unbalanced connector (e.g., a coaxial transmission line (not shown)) using a balun or baluning structure 500. The balun structure 500 is preferably configured for impedance-matched Radio Frequency (RF) energy to flow in either direction within the coaxial transmission line without the introduction of RF energy onto the outside of the coaxial transmission line. As can be appreciated, RF energy flowing on the outside of the coaxial transmission line is inherently wasteful and generally distorts the directive pattern of the directional antenna array, thus lowering the maximum bore sight gain.

Figure 5:
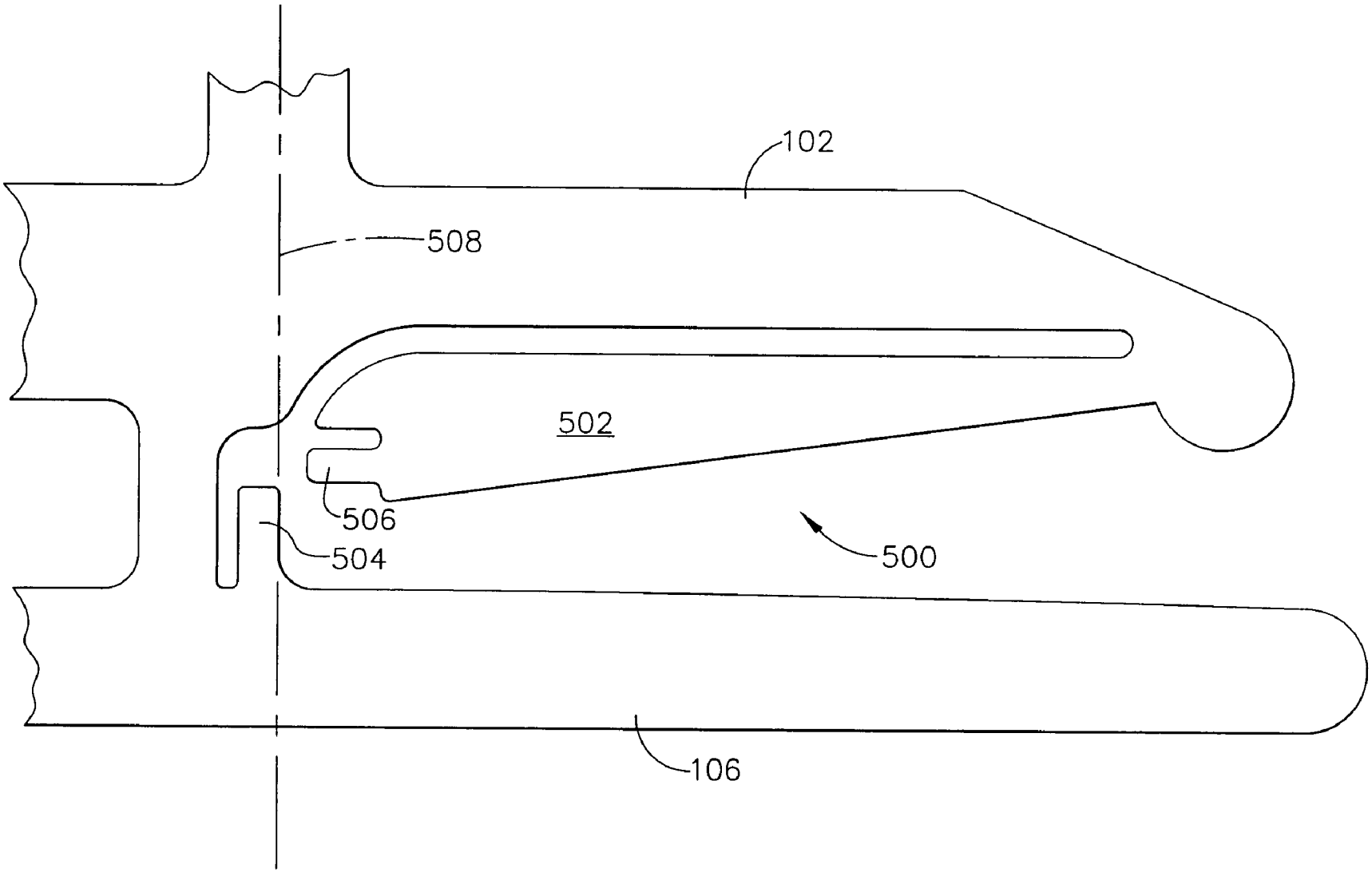
FIG. 5 is a balun structure for the directional antenna array of FIG. 1 in accordance with an exemplary embodiment of the present invention.

Referring to FIG. 5, an enlarged view of the driven element 102 is shown that presents an exemplary embodiment of the balun structure 500 in accordance with an exemplary embodiment of the present invention. The balun structure 500 is preferably formed from the monolithic material as previously described in this detailed description and includes a dipole structure 502 and two feed points (i.e., a first feed point 504 and a second feed point 506) that are configured to receive the unbalanced connector, which in this example is a coaxial transmission line. In addition, the balun structure also preferably includes a difference between a first width ($W_{dri}$) 122 of the driven element 102 and a second width ($W_{dri2}$) 132 of the driven element 102 as shown in FIG. 1, which creates an electrical offset that can be adjusted to assist with nulling of the RF energy that otherwise would appear on the outer conductor of the coaxial transmission line. For example, the first width ($W_{dri}$) 122 is greater than a second width ($W_{dri2}$) 132 of the driven element 102. However, any number of unbalanced connector configurations can be used in accordance with the present invention.

Continuing with reference to FIG. 5, the first feed point 506 preferably extends from the dipole structure 502 and preferably receives the center conductor of the coaxial transmission line (i.e., the center conductor of the coaxial transmission line is connected to the first feed point 506). The second feed point 504 preferably extends from the reflector element 106 and receives the outer conductor of the coaxial transmission line (i.e., the outer conductor of the coaxial transmission line is connected to the second feed point 504). However, the first feed point 506 and the second feed point 504 can exist at other locations of the directional antenna array.

The dipole structure 502 is preferably off the center line 508 (i.e., off-center) of the directional antenna array and the dipole structure 502 is preferably a one-half folded dipole that is tapered, which feeds RF energy onto the driven element 102. The tapering of the one-half folded dipole serves a number of purposes, including, but not limited to, the dual purpose of providing a type of broad-band tapered impedance match to the driven element 102 as well as synthesizing a shunt capacitor in the vicinity of attachment point for the center of the coaxial transmission line. This provides numerous desirable features, including, but not limited to, a significantly lowered Voltage Standing Wave Ratio (VSWR) over a wider bandwidth of operation.

The off-center attachment of the balun structure 500 is configured to transmit the received signal in the following manner and the principle of antenna reciprocity will indicate equal validity of the principles during signal reception. During the time that the directional antenna array is transmitting an electromagnetic signal, the positive current that is launched by the center conductor of the coaxial transmission line would normally cause a current of substantially equal magnitude to be launched into the directional antenna array at the second feed point 504. However, without the corrective action of the balun structure 500, RF energy would be launched onto the coaxial transmission line outer conductor. As the driven element 102 operates with a circuit Q of approximately ten (10), which means that the circulating RF energy is about ten (10) times larger than that which is being supplied by the transmission line, the off-centered feed points (504,506) cause a small amount of reversed-phase circulating RF energy to be launched onto the outer conductor of the coaxial transmission line.

When the positional or electrical offset of the feed points (504,506) are properly established, a cancellation of the composite RF energy results that would have been launched onto the outer conductor of the coaxial transmission line. Fine tuning of the electrical offset provided by the two feed points (504,506) can be accomplished without changing the resonant frequencies of the other elements of the directional antenna array with a number of techniques, such as offsetting the electrical position of the driven element 102 and/or the reflector element 106 as shown in FIG. 5 with an adjustment of the length on one side and positioning a piece of conductive tape on the other side. Alternatively, the relative widths of the left and right side of these elements can be adjusted accordingly. The electrical offsetting procedure is complete, and the baluning structure 500 has achieved a substantial balance when minimal and RF current can be sensed on the outer conductor.

The balun structure 500, element widths and/or the monolithic nature of the directional antenna array as previously described in this detailed description provide numerous desirable features. For example, the directional antenna array of the present invention has a low profile and can conform to any number of shapes. In addition, the directional antenna array of the present invention can maintain structural shape and integrity, including maintenance of structural shape and integrity after application of an external force.

Figure 6:
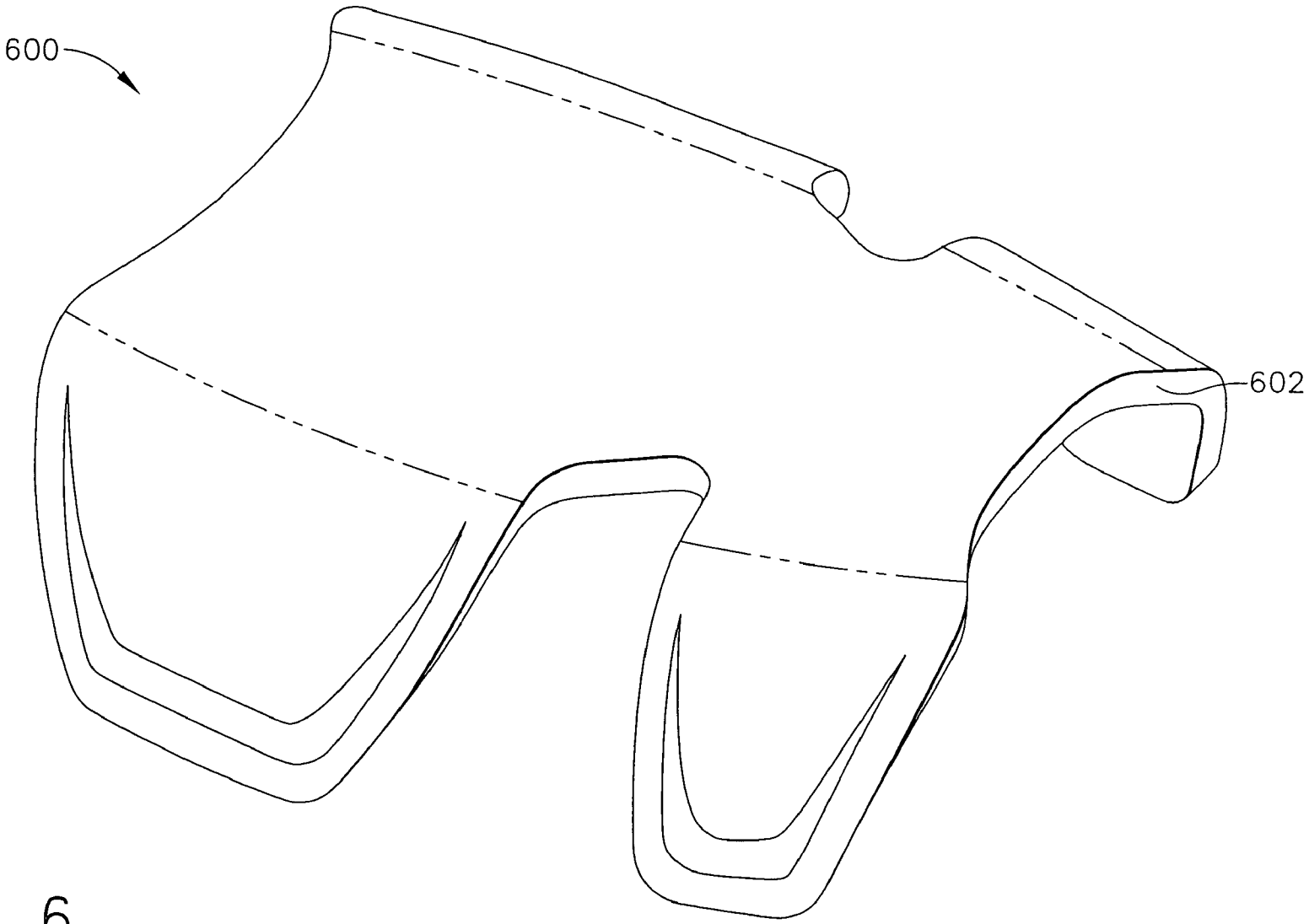
FIG. 6 is the directional array antenna of FIG. 3 with an elastomer cover in accordance with an exemplary embodiment of the present invention.
Figure 7:
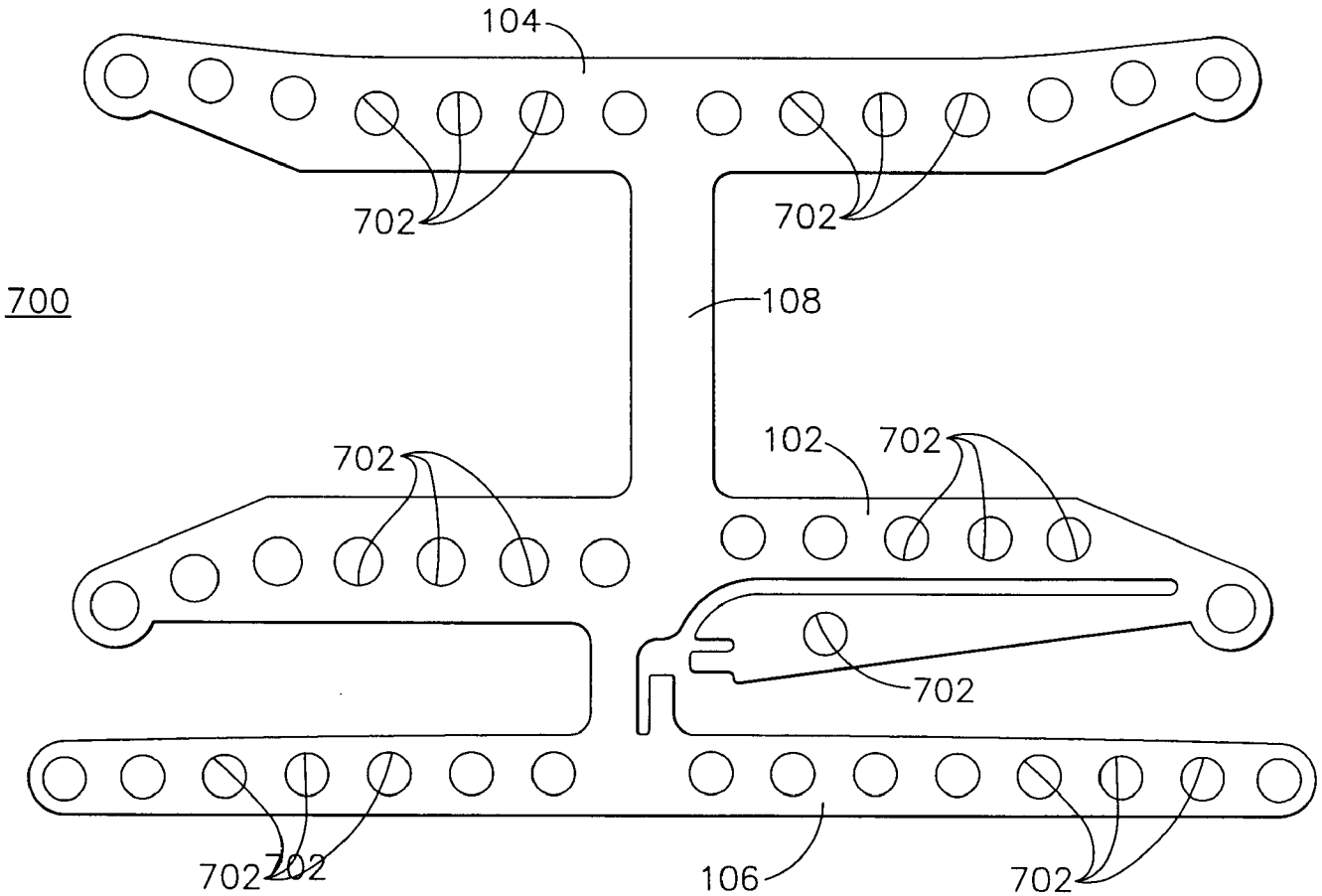
FIG. 7 is the directional array antenna of FIG. 1 with apertures.

In order improve the ability of the directional antenna to maintain structural shape and integrity, including maintenance of structural shape and integrity after application of an external force, a portion of the directional antenna array 600 and more preferably a substantial portion or substantially all or all of the directional antenna array 600 is covered with an elastomer 602 as shown in FIG. 6. The directional antenna array 600 can be configured to provide at least a portion of the structural support of the elastomer 602, and apertures 702 are preferably formed in one and preferably all of the elements of the directional antenna array 700 as shown in FIG. 7. This increases the ability of the directional antenna array 700 to survive surface impacts, which is beneficial in numerous environments and applications. For example, this low profile and rugged directional antenna array is beneficial in numerous electronics applications, including portable or hand-held devices such as cellular telephones, satellite telephones and contactless interrogators of Automatic Identification (Auto ID) systems, such as RFID interrogators of RFID systems.

Figure 8:
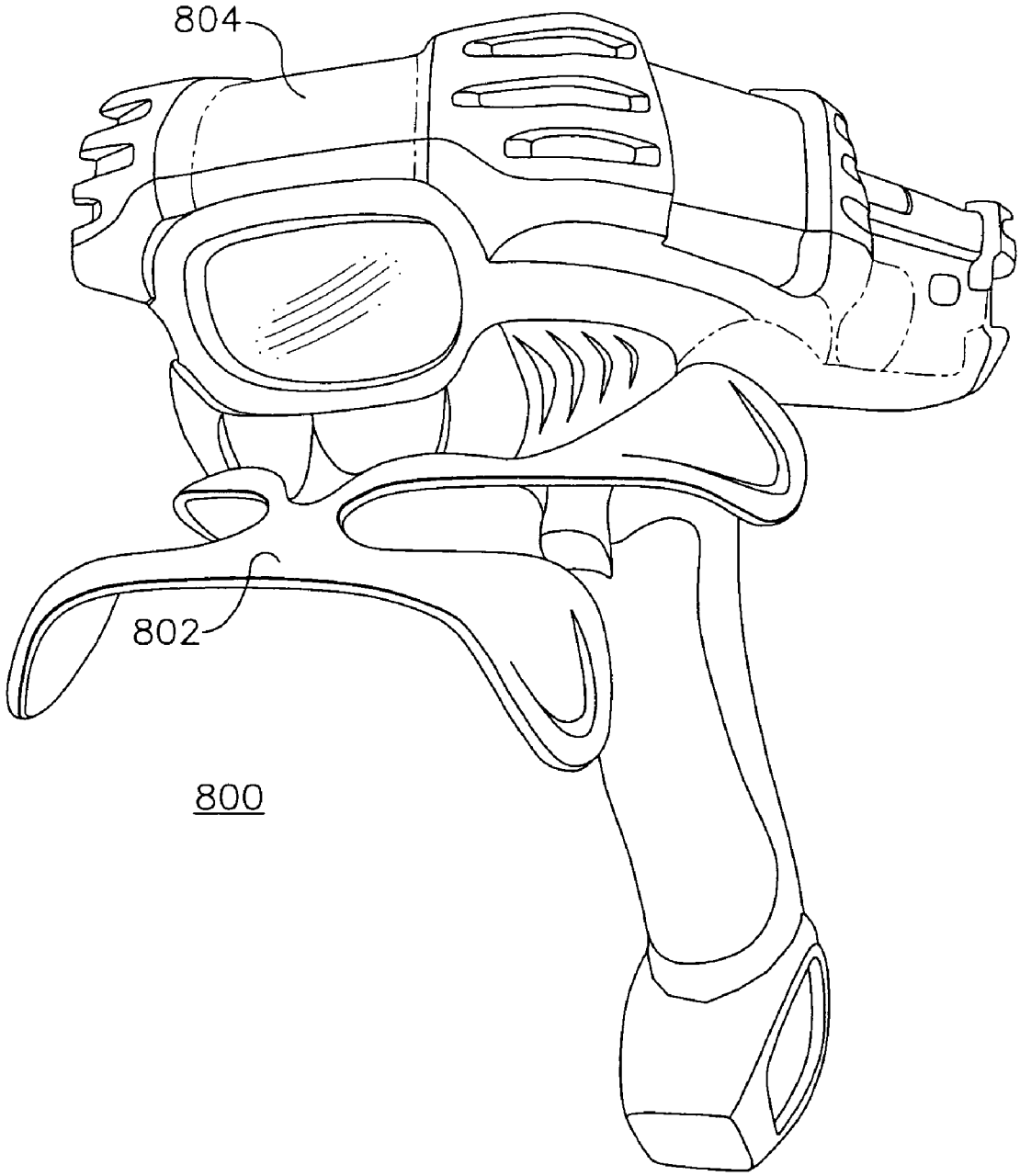
FIG. 8 is a portable/handheld device having the directional antenna array of FIG. 6 in accordance with an exemplary embodiment of the present invention.

Referring to FIG. 8, portable/handheld device 800 is illustrated in accordance with an exemplary embodiment of the present invention. The portable/handheld device 800, which in this illustrative example is an RFID interrogator of an RFID system, includes a processing module 804 (e.g., an RFID processing module having any number of configurations known to those of ordinary skill in the art) 804 and the directional antenna array 802 in accordance one or more of the embodiments of the directional antenna array 802 as previously described in this detailed description. However, as can also be appreciated by those of ordinary skill in the art, a portable/handheld device of other electronic systems can be formed in accordance with the present invention or non-portable non-handheld devices can be formed in accordance with the present invention.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A directional antenna array comprising:

a driven element;

a first parasitic clement spaced apart from said driven element, wherein at least one of said first parasitic element and said driven element have a width that is greater than about one-half a percent (0.5%) of a free-space wavelength of the directional antenna array; and a balun structure, wherein said balun structure comprises:

a dipole structure;

a first feed point extending from said dipole structure, and a second feed point extending from said first parasitic element.

2. The directional antenna ray of claim 1, wherein said dipole structure is off a center line of the directional antenna array.

3. The directional antenna array of claim 1, wherein said dipole structure is a one-half folded dipole.

4. The directional antenna array of claim 1, wherein said dipole structure is a tapered structure.

5. A directional antenna array, comprising:

a first parasitic element;

a driven element spaced apart from said first parasitic element; and a balun structure configured to couple said driven element to at least one of an electromagnetic energy source and an electromagnetic sink, said balun structure comprising:

a dipole structure;

a first feed point extending from said dipole structure, and a second feed point extending from said first parasitic element.

6. The directional antenna array of claim 5, wherein said dipole structure is off a center line of the directional antenna array.

7. The directional antenna array of claim 5, wherein said dipole structure is a one-half folded dipole.

8. The directional antenna array of claim 5, wherein said dipole structure is a tapered structure.

9. The directional antenna array of claim 5, wherein said dipole structure further comprises a first width of the driven element and a second width of the driven element.

10. The directional antenna array of claim 5, wherein at least one of said first parasitic element and said driven element have a width that is greater than about one-half a percent (0.5%) of an free-space wavelength of the directional antenna array.

11. The directional antenna array of claim 5, wherein said width is greater than about, one percent (1%) of said free-space wavelength of the directional antenna array.

12. The directional antenna array of claim 5, wherein said width is greater than about two percent (2%) of said free-space wavelength of the directional antenna array.

13. The directional antenna array of claim 5, wherein said width is greater than about four percent (4%) of said free-space wavelength of the directional antenna array.

14. The directional antenna army of claim 5, further comprising a second parasitic element that is separated from said driven element, wherein said at least one of said first parasitic element, said driven element and said second parasitic element has said width that is greater than about one-half a percent (0.5%) of an free-space wavelength of the directional antenna array.

15. The directional antenna array of claim 14, further comprising a plurality of parasitic elements in addition to said first parasitic element and said second parasitic element.

16. The directional antenna array of claim 14, wherein said first parasitic element and said second parasitic element are at least substantially in-plane elements.

17. The directional antenna array of claim 14, wherein said second parasitic element is a director element.

18. The directional antenna array of claim 14, wherein said driven element said first parasitic element, said second parasitic element and said balum structure are formed of a monolithic material.

19. The directional antenna array of claim 5, wherein said first parasitic element is a reflector element.

20. The directional antenna array of claim 5, wherein said monolithic material has a resistivity that is greater than about $0.2\times10^{-6}$ ohms-meter.

21. The directional antenna array of claim 5, wherein said monolithic material is spring steel.

22. The directional antenna array of claim 5, further comprising a plurality of apertures in said driven element and said first parasitic element.

23. The directional antenna array of claim 5, further comprising a material covering at least a portion of said driven element and said first parasitic element.

24. The directional antenna array of claim 5, wherein said material covering at least said portion of said driven element and said first parasitic element is an elastomer.

25. A portable/handheld device, comprising:

a processing module; and a directional antenna array coupled to said processing module, said directional antenna array comprising:

a first parasitic element;

a driven element spaced apart from said first parasitic element; and a balun structure configured to couple said driven element to at least one of an electromagnetic energy source and an electromagnetic sink, said balun structure comprising:

a dipole structure;

a first feed point extending from said dipole structure, and a second feed point extending from said first parasitic element.

26. The portable/handheld device of claim 25, wherein said portable/handheld device is an RFID interrogator.

27. The portable/handheld device of claim 25, wherein at least one of said first parasitic element and said driven element have a width that is greater than about one-half a percent (0.5%) of a free-space wavelength of the directional antenna array.

28. The portable/handheld device of claim 27, wherein said width is greater than about one percent (1%) of said free-space wavelength of the directional antenna array.

29. The portable/handheld device of claim 27, wherein said width is greater than about two percent (2%) of said free-space wavelength of the directional antenna array.

30. The portable/handheld device of claim 27, wherein said width is greater than about four percent (4%) of said free-space wavelength of the directional antenna array.

31. The portable/handheld device of claim 27, further comprising a second parasitic element that is separated from said driven element, wherein said at least one of said first parasitic element, said driven element and said second parasitic element has said width that is greater than about one-half a percent (0.5%) of an free-space wavelength of the directional antenna array.

32. The portable/handheld device of claim 31, wherein said first parasitic element and said second parasitic element are at least substantially in-plane elements.

33. The portable/handheld device of claim 31, wherein said second parasitic element is a director element.

34. The portable/handheld device of claim 31, wherein said driven element, said first parasitic element and said second parasitic element are formed of a monolithic material.

35. The portable/handheld device of claim 34, wherein said monolithic material has a resistivity that is greater than about $0.2\times10^{-6}$ ohms-meter.

36. The portable/handheld device of claim 35, wherein said monolithic material is spring steel.

37. The portable/handheld device of claim 31, further comprising a plurality of apertures in said driven element, said first parasitic element and said second parasitic element.

38. The portable/handheld device of claim 27, further comprising a plurality of parasitic elements in addition to said first parasitic element and said second parasitic element.

39. The portable/handheld device of claim 27, wherein said fixst parasitic element is a reflector element.

40. The portable/handheld device of claim 27, further comprising a material covering at least a portion of said driven element and said first parasitic element.

41. The portable/handheld device of claim 40, wherein said material covering at least said portion of said driven element and said first parasitic element is an elastomer.

* * * * *

UNITED STATES PATENT AND TRADEMARK OFFICE

CERTIFICATE OF CORRECTION

PATENT NO. : 7,205,953 B2
APPLICATION NO. : 10/661652
DATED : April 17, 2007
INVENTOR(S) : Knadle, Jr. et al.

It is certified that error appears in the above-identified patent and that said Letters Patent is hereby corrected as shown below:

On the Title Page, Item (57)
Abstract, line 5, “an” should be changed to --a--;
Column 7, line 53, “clement” should be changed to --element--;
Column 7, line 65, “ray” should be changed to --array--;
Column 8, line 31, “an” should be changed to --a--;
Column 8, line 42, “army” should be changed to --array--;
Column 8, line 47, “an” should be changed to --a--;
Column 8, line 58, “element said” should be changed to -- element, said--;
Column 8, line 59, “balum” should be changed to --balun--;
Column 10, line 6, “an” should be changed to --a--.
Column 10, line 32, “fixst” should be changed to --first--.

Signed and Sealed this

Twenty-sixth Day of June, 2007

JON W. DUDAS
*Director of the United States Patent and Trademark Office*